US006471147B1

(12) United States Patent
Kuo

(10) Patent No.: US 6,471,147 B1
(45) Date of Patent: Oct. 29, 2002

(54) STRUCTURE WATER SPRAYER HEAD ASSEMBLY

(76) Inventor: Wen-Li Kuo, No. 10, Fang Dong Road, Wen Chin Tsun, Fang Yuan Hsiang, Chang Hua Hsien (TW)

( * ) Notice: Subject to any disclaimer, the term of this patent is extended or adjusted under 35 U.S.C. 154(b) by 0 days.

(21) Appl. No.: 09/572,082

(22) Filed: May 17, 2000

(51) Int. Cl.[7] ..... B05B 1/00

(52) U.S. Cl. ..... 239/600; 239/532; 239/548; 285/258

(58) Field of Search ..... 239/600, 530, 239/532, 548, 555, 557, 558; 285/258, 382.4, 382.5; 29/506, 507

(56) References Cited

U.S. PATENT DOCUMENTS

| | | | | | |
|---|---|---|---|---|---|
| 1,461,130 | A | * | 7/1923 | Loughead | 285/258 |
| 1,753,005 | A | * | 4/1930 | Grady | 29/507 |
| 1,759,224 | A | * | 5/1930 | Dick et al. | 29/507 |
| 1,928,836 | A | * | 10/1933 | Loughead | 29/507 |
| 3,661,004 | A | * | 5/1972 | Lee et al. | 29/506 |
| 3,715,800 | A | * | 2/1973 | Leopold | 29/506 |
| 4,148,438 | A | * | 4/1979 | Moen | 239/530 |

* cited by examiner

*Primary Examiner*—Lesley D. Morris
*Assistant Examiner*—Dinh Q. Nguyen
(74) *Attorney, Agent, or Firm*—Troxell Law Office PLLC

(57) ABSTRACT

An improved structure water sprayer head assembly comprised of a sprayer head having a sleeve with an internal threaded section,formed inside its bottom end, a water sealing ring inserted in the sprayer head sleeve, and a connector having external threads formed around its circumference that enables it to be fastened to the interior section of the sprayer head sleeve, and a long tube. The innovative features include the forming along the inner circumference at the approximate center section of the connector of an annular groove matching the front end of the long tube to the inner diameter at the bottom end of the connector and, furthermore, enables its most forward end to protrude slightly at the front end of the connector. As such, the long tube is situated at the position of the groove formed annularly along the interior section of the connector and there subjected to pressure, enabling a mated insertive junction at the groove formed annularly along the interior section of the connector. Given this structural assembly, not only is the easy and efficient assembly of the connector to the long tube into a unitary body provided for, but when the outer circumference of the connector is fastened to the sleeve of the water sprayer head, an effective watertight closure is provided between the sleeve and the connector.

2 Claims, 7 Drawing Sheets

STRUCTURE WATER SPRAYER HEAD ASSEMBLY

BACKGROUND OF THE INVENTION

1) Field of the Invention

The invention herein relates to an improved structure water sprayer head assembly that remedies the conjoinment difficulty shortcomings encountered in the process of fastening the sprayer head and long tube of conventional water sprayers as well as the associated higher production costs; with the structure of the present invention, in addition to an easier and more efficient method of conjoining the connector to the long tube and thereby form a unitary body, when the outer circumference of the connector is fastened to the sleeve of the sprayer head, an effective watertight closure is formed between the sleeve and the connector.

2) Description of the Prior Art

Conventional water sprayer head assembly structures, as indicated in FIG. 1 and FIG. 2, are comprised of a sprayer head 2 having a circular pattern of numerous fine water output holes 21 in its extreme anterior end surface; a sleeve 22 disposed at the center of its bottom end, with an internal threaded section 221 formed inside the sleeve 22; a water sealing ring 3 inserted in the interior section of the sprayer head 2 sleeve 22; a connector 4 having external threads 41 formed around the circumference of its front section as well as at the end section of its circumference a tubular body 42 of an appropriate length having a water sealing ring around its circumference; an annularly formed mounting groove 43 at the junction area between the connector 4 external threads 41 position and the tubular body 42; and a long tube 5 ensleeved in the bottom section of the tubular body 42 of the connector 4; after the circumference of the front end of the long tube 5 is first ensleeved into the tubular body 42 at the end section of the connector 4, there is expansive force from the most forward end 51 of the long tube 5 such that its most forward end is firmly inserted in the mounting groove 43 at the juncture area between the connector 4 position and the external threads of the tubular body 42, enabling the long tube 5 to be conjoined to the connector 4 as a unitary body; finally, the external threads 41 around the front section circumference of the connector 4 are fastened to the internal threads section 221 inside the sleeve 22 at the center and bottom section of the sprayer head 2 such that the sprayer head 2, the water sealing ring 3, the connector 4, and the long tube 5 are assembled into a completed water sprayer head assembly structure.

However, in the said structure and especially at the section of the assembly structure between the connector 4 and the long tube 5; first, since a tubular body 42 of an appropriate length must be formed at the bottom section of the connector 4 such that when the connector 4 is fabricated, the said tubular body 42 necessarily involves increased material cost; second, when the long tube 5 is assembled to the tubular body 42 of the connector 4 to form a unitary body, since after the front end of the long tube 5 is ensleeved onto the circumference of the tubular body 42 formed at the end section of the connector 4, due to the expansive force at the most forward end 51 of the long tube 5, its most forward end can be inserted into the mounting groove 43 along the junction area between the connector 4 position external threads 41 and the tubular body 42 such that the insertive conjoinment area forms a recessed profile that is not only unattractive, but since only a small portion of the most forward end 51 of the long tube 5 is conjoined to the connector 4 and, furthermore, entry is just at the initial extent of the high pressure water flow of the water sprayer, which after flowing through the interior section of the long tube 5, the interior section of the connector 4, and then the interior section of the sprayer head 2, the water is finally dispersed from the circular pattern of numerous fine water output holes 21 in the extreme anterior end surface of the sprayer head 2, the conventional assembly structure is incapable of effectively bearing the overall water pressure though the long tube 5, the connector 4, and finally during the dispersal of the water from the fine water output holes 21 in the extreme anterior end surface of the sprayer head 2, with the incapability of withstanding high pressure being an existent shortcoming that awaits improvement.

Referring to FIG. 3 and FIG. 4, another type of water sprayer head assembly structure available on the market is comprised of a sprayer head 2 having a circular pattern of numerous fine water output holes 21 in its extreme anterior end surface; a sleeve 22 disposed at the center of its bottom end, with an internal threaded section 221 formed inside the sleeve 22; a water sealing ring 3 inserted in the interior section of the sprayer head 2 sleeve 22; a connector 4 having external threads 41 formed around the circumference of its front section as well as a tubular body 42 of an appropriate length at the end section of its circumference; and a water sealing ring on the circumference of a tubular body 42; after the front section of the long tube 5 is ensleeved into the tubular body 42 formed at the end section and circumference of the connector 4, since an expansive force is directly against the tubular body 42 at the bottom section of the connector 4 and the formed threads, the tubular body 42 section of the connector 4 and the long tube 5 are ensleeved by engagement onto the zigzag profile threads 52 along the circumference of the said tubular body 4, thereby forming a unitary body; finally, the external threads 41 around the front section circumference of the connector 4 are fastened to the internal threads section 221 inside the sleeve 22 at the center and bottom section of the sprayer head 2 such that the sprayer head 2, the water sealing ring 3, the connector 4, and the long tube 5 are similarly assembled into a completed water sprayer head assembly structure.

However, in the said structure, the section of the assembly structure between the connector 4 and the long tube 5 is similar; first, since a tubular body 42 of an appropriate length must be formed at the bottom section of the connector 4 such that when the connector 4 is fabricated, the said tubular body 42 necessarily involves increased material cost; second, when the long tube 5 is assembled to the tubular body 42 of the connector 4 to form a unitary body, after the front end of the long tube 5 is ensleeved onto the circumference of tubular body 42 formed at the end section of the connector 4, due to the direct expansive force of the threads around the tubular body 42 at the bottom section of the connector 4, the tubular body 42 section of the connector 4 and the long tube 5 are ensleeved by engagement onto the zigzag profile threads 52 around the circumference of the said tubular body 42 and, in addition to the similar unattractive appearance of the externally visible zigzag thread path, the tubular body 42 section of the connector 4 as well as the thickness of the long tube 5 cannot be too massive, otherwise, during the process of attaching the tubular body 42 of the connector to the front section of the long tube 5, the shortcoming of ineffective engagement of the two occurs and, furthermore, since the material thickness is relatively thin, the shortcoming of reduced structural strength occurs; furthermore, due to the conjunction situation of the circumference of the tubular body 24 of the connector 4 with the ensleeving section at the front section of the long tube 5 and since it is not possible to install any water sealing ring onto the circumference of the tubular body 42 of the connector 4, this causes the occurrence of the shortcoming of an ineffective and poor watertight closure formed between the two components which awaits improvement.

Therefore, in view of the existent said shortcomings of the conventional structures that await improvement, the inventor of the invention, based on years of experience gained from engagement in various water application, landscaping, and other related hardware marketing, production, and assembly as well as after-sales feedback from consumers, conducted extensive research informed by the said factors that culminated in the development of the invention herein which is hereby submitted for patent application.

SUMMARY OF THE INVENTION

The primary objective of the invention herein is to provide an improved structure water sprayer head assembly comprised of a sprayer head having a sleeve with an internal threaded section formed inside its bottom end, a water sealing ring inserted in the sprayer head sleeve, and a connector having external threads formed around its circumference that enables it to be fastened to the internal section of the sprayer head sleeve, and a long tube, the innovative features of which include the forming along the inner circumference at the approximate center section of the connector of an annular groove matching the front end of the long tube to the inner diameter at the bottom end of the connector and, furthermore, enables its most forward end to protrude slightly at the front end of the connector such that the long tube is situated at the position of the groove formed annularly along the interior section of the connector and there subjected to pressure, enabling a mated insertive junction at the groove formed annularly along the interior section of the connector and given the said structural assembly, not only is the easy and efficient assembly of the connector to the long tube into a unitary body made possible, but when the outer circumference of the connector is fastened to the sleeve of the water sprayer head, an effective watertight closure is provided between the sleeve and the connector.

Another objective of the invention herein is to provide an improved structure water sprayer head assembly in which after the connector and the long tube are firmly conjoined, since the front end of the long tube is within the inner diameter at the bottom end of the connector and, furthermore, when the most forward end is firmly against the external threads formed on the circumference of the connector and the sleeve fastened to the bottom end of the sprayer head and inserted over the water sealing ring inside the sleeve, the high pressure water flow at the initial interior section of the long tube is caused, after it passes directly through the interior section of the sprayer head, to be dispersed out of the circular pattern of numerous fine water output holes in the anterior end surface of the sprayer head such that leakage of the high pressure water flow does not occur at the junction area between the connector and the long tube, thereby achieving an effective watertight closure, which is among the innovative features of the invention herein.

Yet another objective of the invention herein is to provide an improved structure water sprayer head assembly in which after the connector and the long tube are firmly conjoined, since the front end of the long tube is modified from the interior diameter at the bottom end of the connector and, furthermore, when the most forward end is firmly against the external threads formed on the circumference of the connector and the sleeve fastened to the bottom end of the sprayer head and inserted over the water sealing ring inside the sleeve, the entire connector only requires the fabricating of an external threads section for fastening to the front section of the sprayer head sleeve without having to dispose the on the end section a tubular body as is the case with a conventional connector such that during initial fabrication, this effectively saves material costs, which is among the innovative features of the invention herein.

To further understand the structure, innovative features, and function of the invention herein, the brief description of the drawings below is followed by the detailed description of the invention for purposes of review and reference.

DETAILED DESCRIPTION OF THE INVENTION

Figure 1:
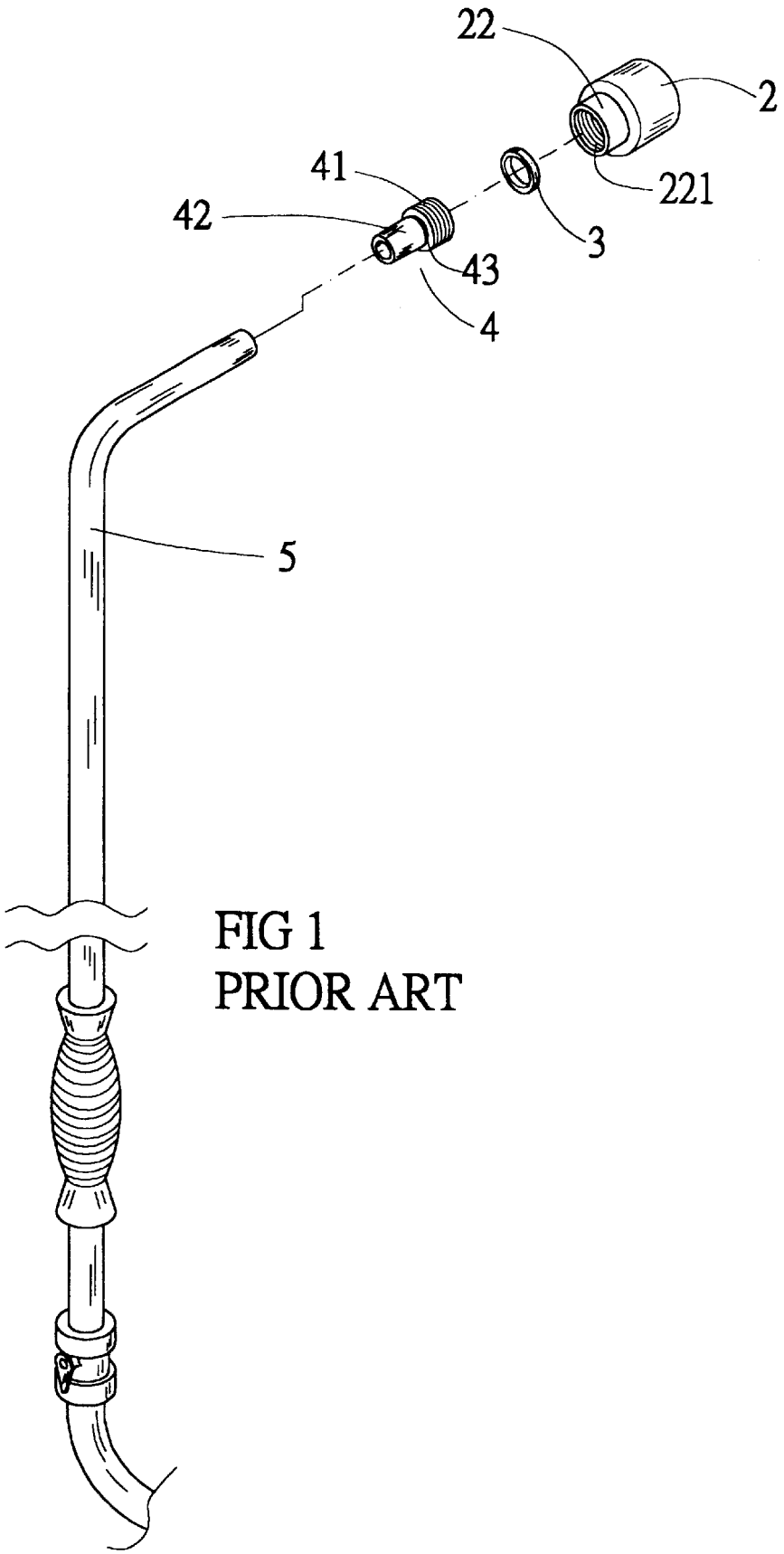
FIG 1 PRIOR ART
FIG. 1 is an isometric drawing of a conventional water sprayer.
Figure 2:
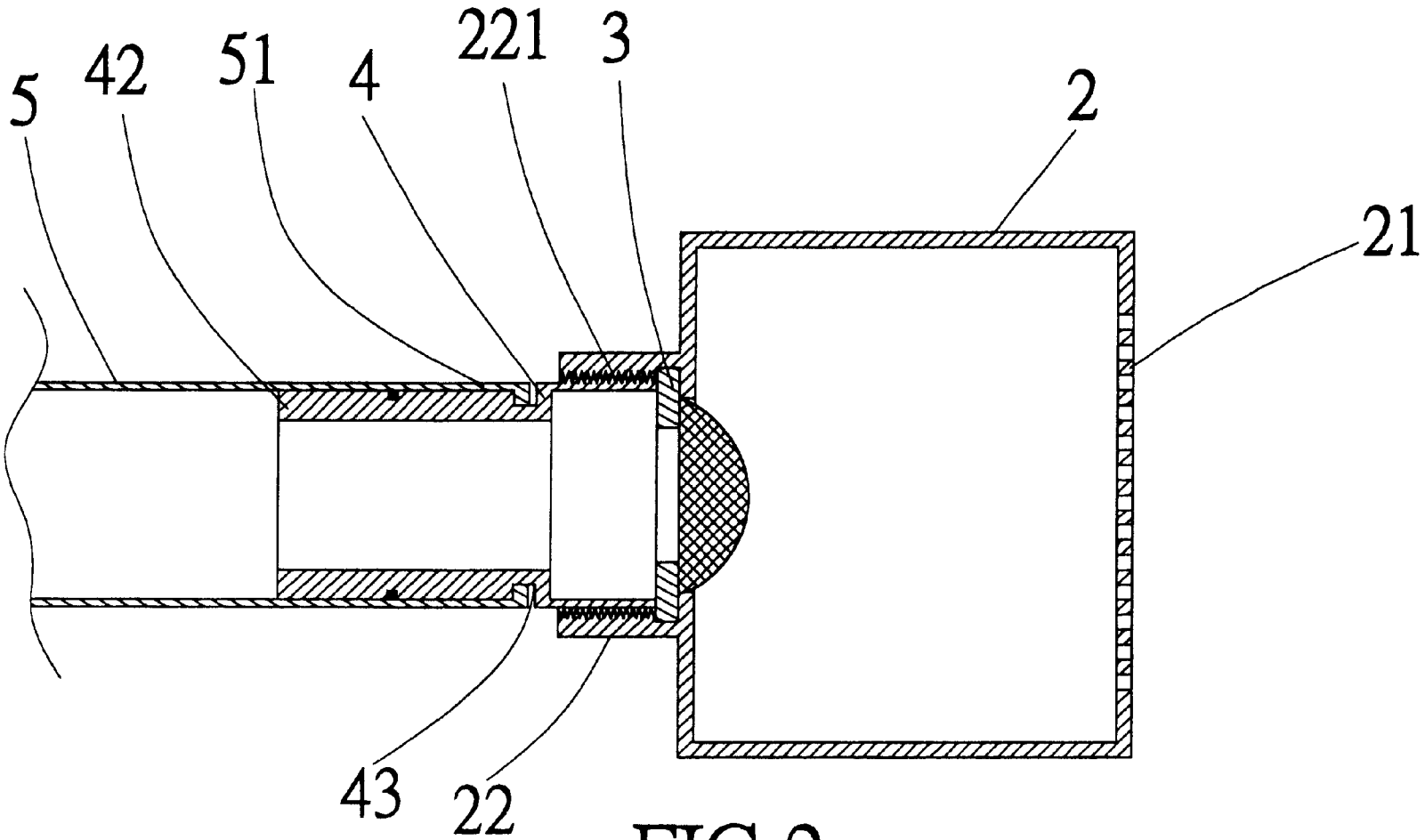
FIG 2 PRIOR ART
FIG. 2 is a cross-sectional drawing of the sprayer head section of the conventional water sprayer structure.
Figure 3:
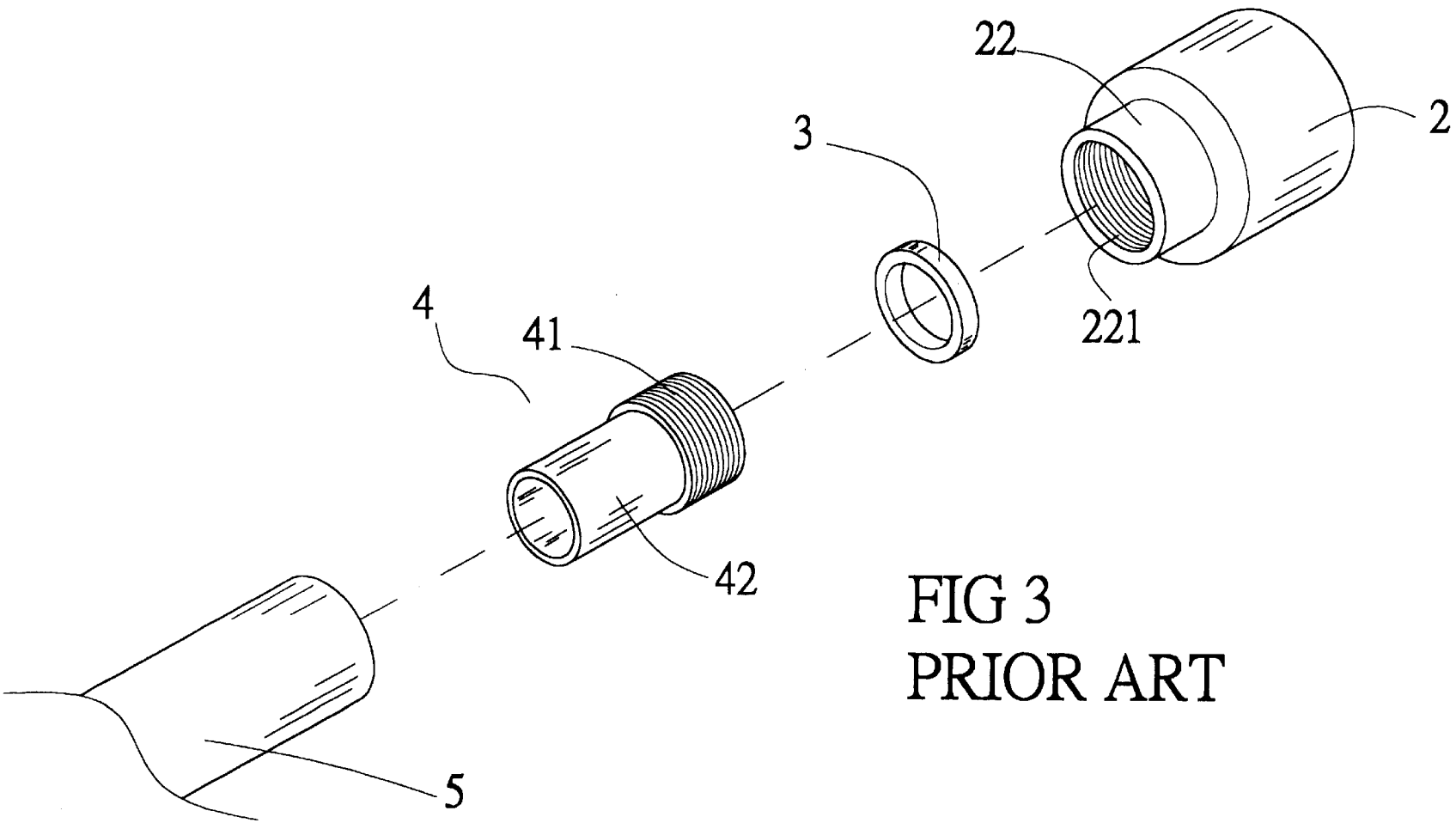
FIG 3 PRIOR ART
FIG. 3 is an exploded drawing of the sprayer head section of the conventional water sprayer structure.
Figure 4:
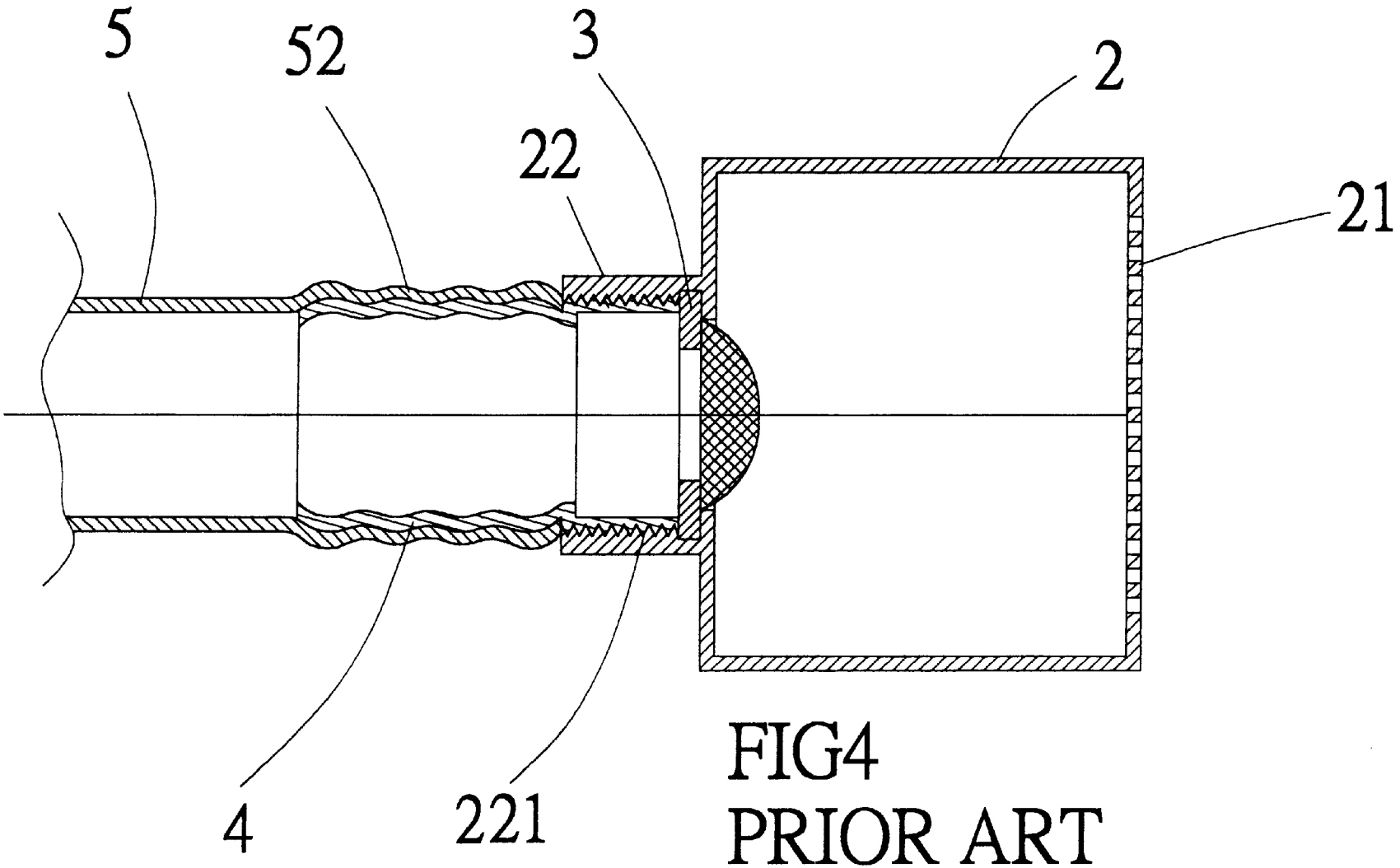
FIG4 PRIOR ART
FIG. 4 is a cross-sectional drawing of the sprayer head section of the conventional water sprayer structure.
Figure 5:
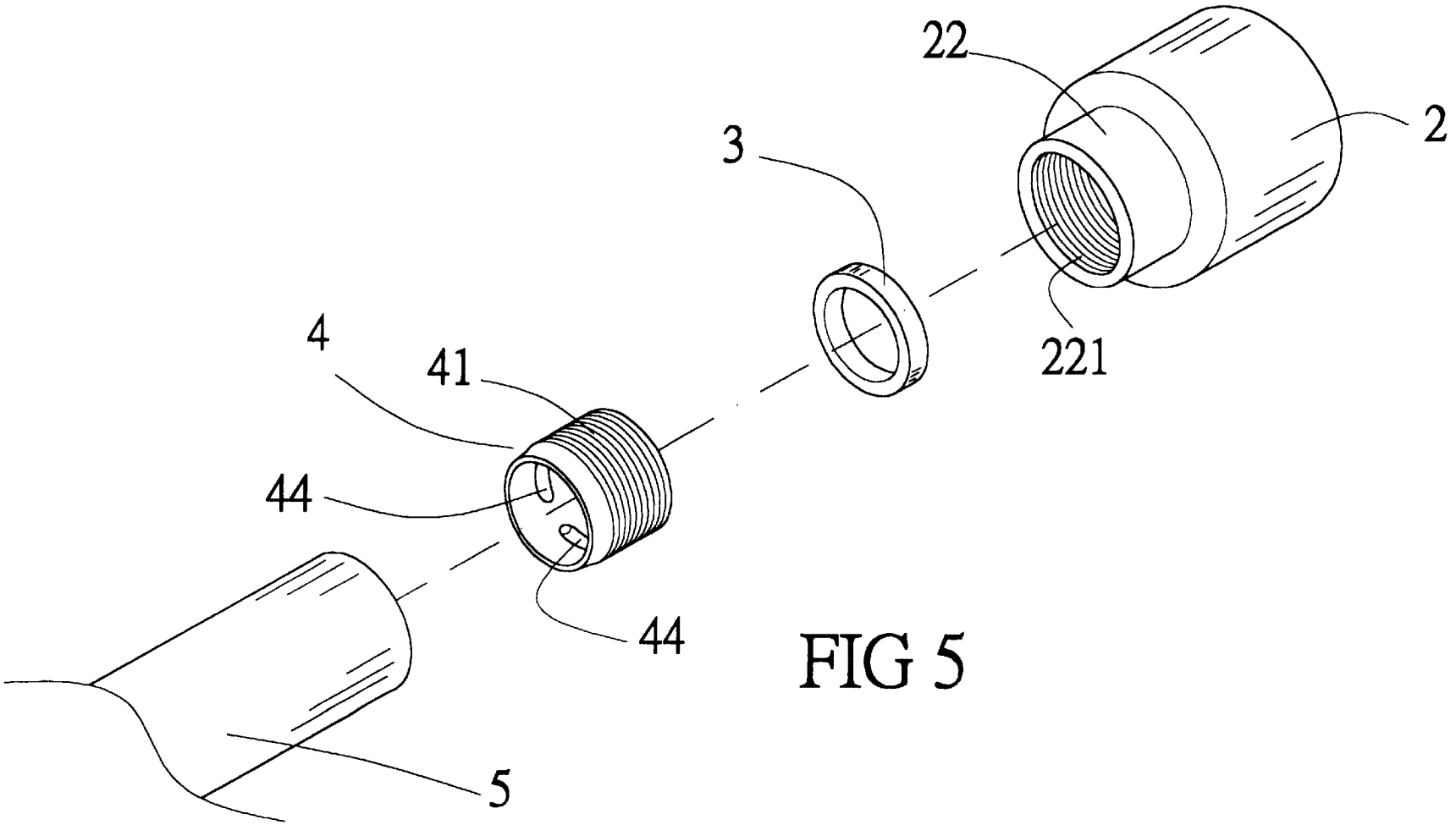
FIG. 5 is an exploded drawing of the sprayer head section of the water sprayer assembly structure of the invention herein.
Figure 6:
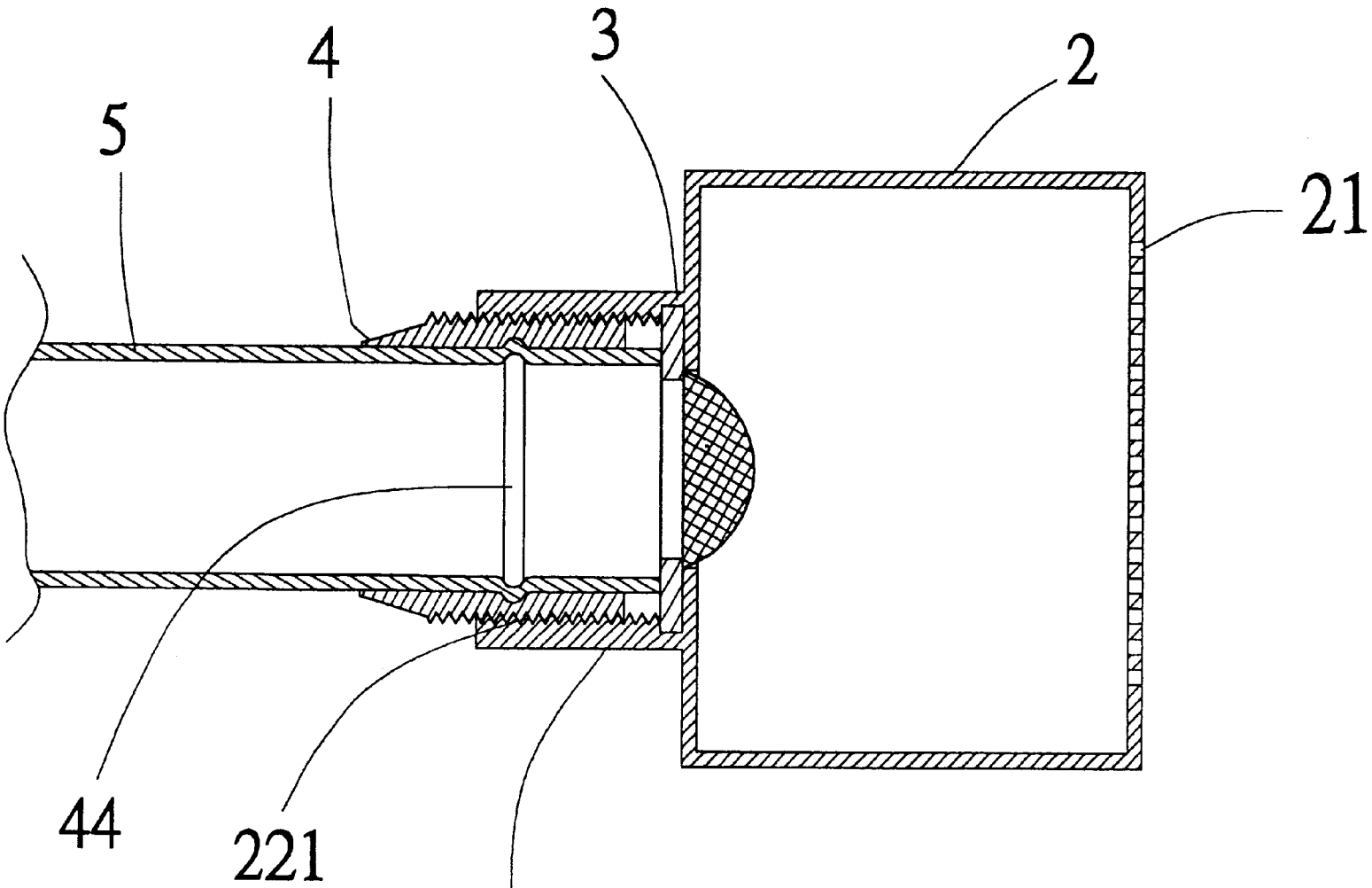
FIG. 6 is a cross-sectional drawing of the sprayer head section of the water sprayer assembly structure of the invention herein.

Referring to FIG. 5 and FIG. 6, the water sprayer head assembly structure of the invention herein is comprised of a sprayer head 2 having a circular pattern of numerous fine water output holes 21 in its extreme anterior end surface; a sleeve 22 disposed at the center of its bottom end, with an internal threaded section 221 formed inside the sleeve 22; a water sealing ring 3 inserted in the interior section of the sprayer head 2 sleeve 22; a connector 4 having external threads 41 formed around its circumference; and a long tube 5; innovatively formed along the inner circumference at the center section of the connector 4 of the present invention is an annular groove 44 that matches the front end of the long tube 5 to the inner diameter of the connector 4 and, furthermore, enables its most forward end to protrude slightly at the front end of the connector 4, such that after the long tube 5 is ensleeved into the interior section of the connector 4 from the bottom end of the connector 4 and is protruding slightly from the front end of the connector 4, the long tube 5 is situated at the position of the groove 44 formed annularly along the interior section of the connector 4 and subjected to pressure such that the long tube 5 is ensconced in the connector 4, with the two components thereby easily assembled into a unitary body; finally, the external threads 41 around the circumference of the connector 4 are fastened into the internal threaded section 221 formed inside the sleeve 22 at the bottom end of the sprayer head 2 such that the sprayer head 2, the water sealing ring 3, the connector 4, and the long tube 5 are assembled into a completed water sprayer head assembly structure.

In the said structural assembly, since the front end of the long tube 5 is ensconced at the bottom end and interior section of the connector 4 and, furthermore, when the most forward end is being held at the external threads 41 along the circumference of the connector 4, it is fastened to the sleeve 22 at the bottom end of the sprayer head 2 against the water sealing ring 3 inserted inside the sleeve 22; therefore, in addition to achieving material cost savings by only having to fabricate the external threads 41 section for fastening to the front section of the sprayer head 2 sleeve and not having to dispose the same on the end section the tubular body 42 such as is the case with a conventional connector, the high pressure water flow within and at the very start of the interior section of the long tube 5 travels directly through the interior section of the sprayer head 2 and directly dispersed out of the fine water output holes 21 in the extreme anterior end surface of the sprayer head 2 such that leakage of the high pressure water flow does not occur at the junction area between the connector 4 and the long tube 5, thereby achieving an effective watertight closure.

Figure 7:
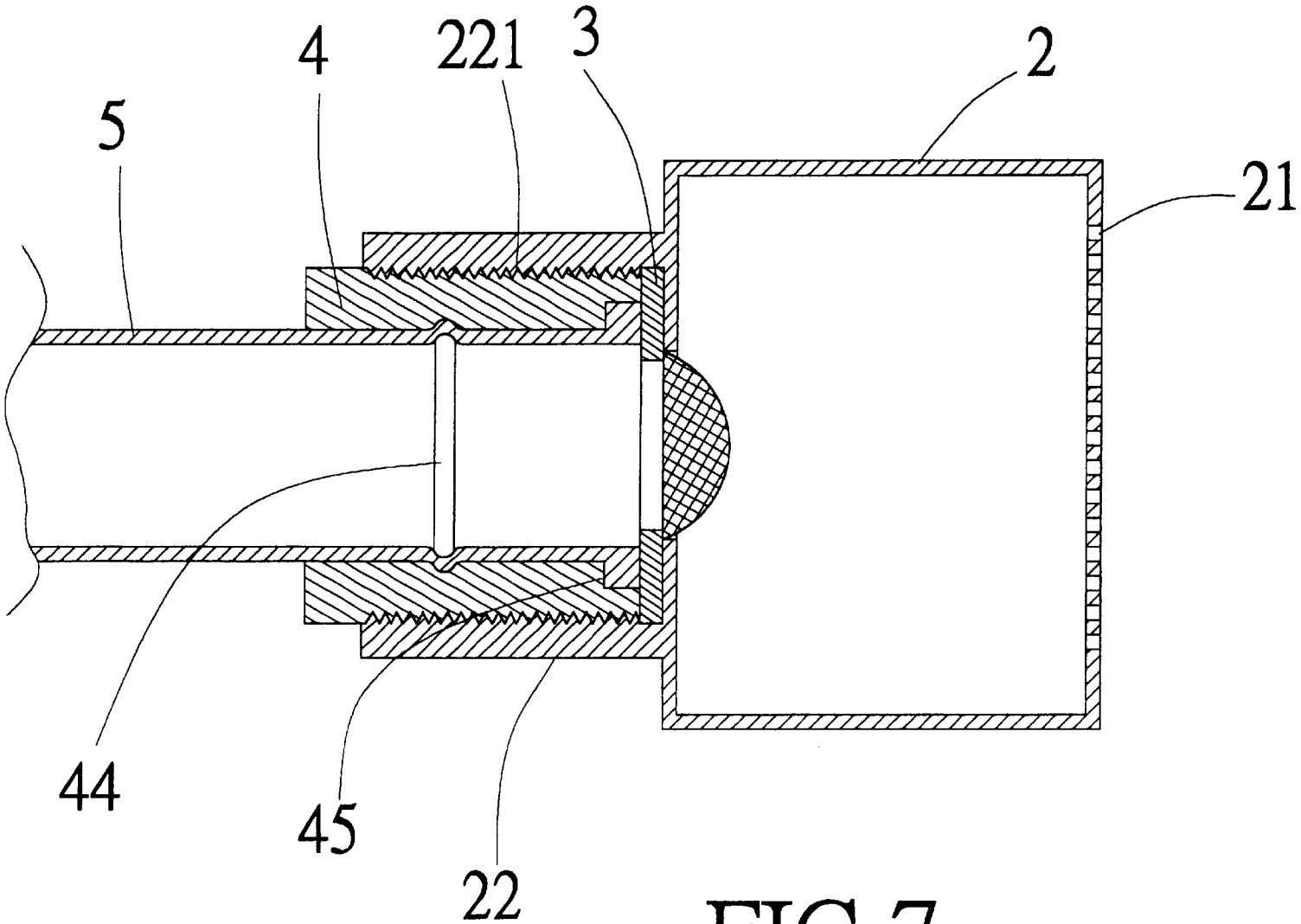
FIG. 7 is a cross-sectional drawing of the sprayer head section of another water sprayer assembly structure embodiment of the invention herein.

Additionally, referring to FIG. 7, after the annular groove 44 is formed along the inner circumference at the center section of the connector 4, a mounting groove 45 can be formed at the extreme front end along the inner circumference of the connector 4 that matches the front end of the long tube 5 to the inner diameter at the bottom end of the connector 4 and, furthermore, enabling expansive force at the most forward end during insertion into the mounting groove 45 formed at the extreme front end along the inner circumference of the connector 4, thereby providing for the easy assembly of the connector 4 and long tube 5 into a unitary body.

In summation of the foregoing section, since the invention herein offers conveniences and benefits superior to that of the conventional structures.

What is claimed is:

1. A water sprayer head assembly comprising:

a) a tube having an outer surface and a tube end;

b) a connector sleeve mounted on the outer surface of the tube, the connector sleeve having a groove in an inner surface whereby a portion of the tube engages the groove, the connector sleeve having two opposite ends and being located such that neither of the two opposite ends extend outwardly beyond the tube end;

c) a sprayer head having a plurality of water output holes in an end surface and an attachment sleeve connected with the connector sleeve; and, d) a water sealing ring in contact with the sprayer head and in direct contact with the tube end.

2. The water sprayer head assembly of claim 1 wherein the tube end extends outwardly beyond an adjacent one of the two opposite ends of the connector sleeve.

* * * * *